US009393579B2

(12) United States Patent
Ponomarev

(10) Patent No.: US 9,393,579 B2
(45) Date of Patent: Jul. 19, 2016

(54) CLEANING APPARATUS AND METHOD OF CLEANING A CONTAMINATED SURFACE

(71) Applicant: The Boeing Company, Seal Beach, CA (US)

(72) Inventor: Sergey G. Ponomarev, Seattle, WA (US)

(73) Assignee: The Boeing Company, Chicago, IL (US)

( * ) Notice: Subject to any disclaimer, the term of this patent is extended or adjusted under 35 U.S.C. 154(b) by 844 days.

(21) Appl. No.: 13/644,195

(22) Filed: Oct. 3, 2012

(65) Prior Publication Data

US 2014/0090670 A1 Apr. 3, 2014

(51) Int. Cl.

| | |
|---|---|
| ***B05B 7/08*** | (2006.01) |
| ***B05B 7/24*** | (2006.01) |
| ***B05B 1/14*** | (2006.01) |
| ***B08B 3/02*** | (2006.01) |
| ***B05B 7/00*** | (2006.01) |
| *B05B 7/16* | (2006.01) |

(52) U.S. Cl.

CPC ..... *B05B 7/0093* (2013.01); *B05B 7/0876* (2013.01); *B05B 7/0892* (2013.01); *B08B 3/02* (2013.01); *B05B 7/1686* (2013.01); *B08B 2230/01* (2013.01)

(58) Field of Classification Search

CPC ..... B05B 7/0093; B05B 7/2486; B05B 7/26; B05B 7/0876; B05B 7/0892; B05B 9/007; B05B 1/14

See application file for complete search history.

(56) References Cited

U.S. PATENT DOCUMENTS

| | | | | |
|---|---|---|---|---|
| 2,624,618 | A | 1/1953 | Gelles et al. | |
| 2,753,212 | A | 11/1953 | Aultman | |
| 2,755,130 | A | 7/1956 | Arant | |
| 2,896,861 | A * | 7/1959 | Hruby, Jr. | A63C 31/02 239/237 |
| 2,919,070 | A | 12/1959 | Arant | |
| 3,039,454 | A | 6/1962 | Gilbertson et al. | |
| 3,687,156 | A * | 8/1972 | Minich, Jr. | B60S 3/047 137/334 |
| 4,036,434 | A | 7/1977 | Anderson et al. | |
| 4,414,037 | A | 11/1983 | Friedheim | |
| 4,565,324 | A * | 1/1986 | Rebula | B05B 1/14 122/390 |
| 4,826,084 | A * | 5/1989 | Wallace | B05B 7/06 239/290 |
| 5,186,389 | A * | 2/1993 | Shibano | B08B 3/12 239/102.2 |
| 5,224,236 | A | 7/1993 | Sallquist | |

(Continued)

FOREIGN PATENT DOCUMENTS

| | | | |
|---|---|---|---|
| DE | 102004001256 | A1 | 8/2005 |
| GB | 2388332 | A | 11/2003 |
| WO | 2013062646 | A1 | 5/2013 |

OTHER PUBLICATIONS

EPO Extended Search Report for related application 13187162.6-1703/2716375 dated Mar. 28, 2014.

Saturnino, C., et al., "Chemical Cleaning Materials and Processes", Technical Note N-611, Defense Documentation Center for Scientific and Technical Information, U.S. Naval Civil Engineering Laboratory, Jul. 9, 1964, pp. 23.

(Continued)

*Primary Examiner* — Michael Kornakov
*Assistant Examiner* — Natasha Campbell
(74) *Attorney, Agent, or Firm* — Armstrong Teasdale LLP

(57) ABSTRACT

A cleaning apparatus is provided that includes a first nozzle configured to direct a cleaning jet towards a contaminated surface at a pressure sufficient to remove contaminants from the surface. At least one second nozzle is configured to direct a rinsing jet towards the contaminated surface to remove cleaning fluid therefrom, wherein the rinsing jet is directed at a pressure sufficient to isolate the cleaning jet from an ambient environment.

11 Claims, 5 Drawing Sheets

(56) References Cited

U.S. PATENT DOCUMENTS

| | | | |
|---|---|---|---|
| RE35,879 | E | 8/1998 | Castelli et al. |
| 5,964,952 | A | 10/1999 | Kunze-Concewitz |
| 6,287,389 | B1 | 9/2001 | McGuire |
| 6,571,421 | B1 | 6/2003 | Sham et al. |
| 7,422,641 | B2 | 9/2008 | Nakajima et al. |
| 7,552,505 | B2 | 6/2009 | Eberl |
| 7,891,047 | B2 | 2/2011 | Milanese |
| 2012/0018534 | A1 | 1/2012 | Gilpatrick |
| 2013/0104936 | A1 | 5/2013 | Ponomarev |

OTHER PUBLICATIONS

Bralla, James G., Handbook of Manufacturing Processes—How Products, Components and Materials are Made; Industrial Press, 2007; pp. 329-332.

Sadek, S.E., Condensation of Steam in the Presence of Air; Ind. Eng. Chem. Fundamen.; 1968; vol. 7, No. 2; 1968; pp. 321-324.

Engineering Design Handbook—Design Guidance for Producibility: (AMC 706-100) by U.S. Army Material Command, Knovel Release Date Jul. 8, 2011, Chapter 11-9.

Cleaning Compound, High Pressure Cleaner, Liquid, Aerospace Material Specification AMS-C-22542, 1998.

* cited by examiner

CLEANING APPARATUS AND METHOD OF CLEANING A CONTAMINATED SURFACE

BACKGROUND

The field of the disclosure relates generally to a cleaning apparatus and, more specifically, to a steam cleaning head that may be used for cleaning a contaminated surface.

Cleaning operations are generally used to improve the aesthetic appearance of, and to prepare contaminated surfaces for further processing. Conventional methods for cleaning a contaminated surface generally fall into two categories, mechanical and chemical. Mechanical cleaning generally includes physically removing and/or collecting contaminants with a cloth or other suitable material, and chemical cleaning generally involves using a solvent to break down contamination such that it may be more easily removed from the contaminated surface. Generally, both mechanical and chemical cleaning methods may be used simultaneously to perform a desired cleaning operation.

With respect to cleaning large contaminated surfaces, some known operations used to remove contaminants may include initially applying a cleaning chemical to the contaminated surface and allowing the cleaning chemical to remain on the contaminated surface for a predetermined period of time to break down the contamination. The chemical and broken down contaminants are then rinsed away. However, such cleaning processes may produce a large amount of chemical waste that may be costly to dispose of.

In another known cleaning operation, a microfiber medium is attached to a steam cleaning apparatus such that the microfiber medium can be rubbed against a contaminated surface while steam is delivered thereto. This known cleaning operation generally does not use chemicals or detergents to facilitate cleaning the contaminated surface. However, in at least some known cleaning operations, the use of only steam and mechanical rubbing may not be sufficient to clean or strip a contaminated surface.

BRIEF DESCRIPTION

In one aspect, a cleaning apparatus is provided. The cleaning apparatus includes a first nozzle configured to direct a cleaning jet towards a contaminated surface at a pressure sufficient to remove contaminants from the surface. At least one second nozzle is configured to direct a rinsing jet towards the contaminated surface to remove cleaning fluid therefrom, wherein the rinsing jet is directed at a pressure sufficient to isolate the cleaning jet from an ambient environment.

In another aspect, a cleaning system is provided. The cleaning system includes a housing that includes a cleaning fluid source and a rinsing fluid source housed therein. A cleaning head is coupled to the housing. The cleaning head includes a first nozzle configured to direct a cleaning jet towards a contaminated surface at a pressure sufficient to remove contaminants from the surface. At least one second nozzle is configured to direct a rinsing jet towards the contaminated surface to remove cleaning fluid therefrom, wherein the rinsing jet is directed at a pressure sufficient to isolate the cleaning jet from an ambient environment.

In yet another aspect, a method of cleaning a contaminated surface is provided. The method includes directing a cleaning jet towards a contaminated surface with a first nozzle, the cleaning jet directed at a pressure sufficient to remove contaminants from the surface. A rinsing jet is directed towards a contaminated surface with at least one second nozzle to remove cleaning fluid therefrom, the rinsing jet directed at a pressure sufficient to isolate the cleaning jet from an ambient environment.

DETAILED DESCRIPTION

At least some implementations of the present disclosure relate to a steam based surface cleaning and stripping apparatus that performs two actions simultaneously. In the exemplary implementation, the apparatus cleans surfaces by removing contamination, stripping coatings from substrates, or etch cleaning metals and alloys with a steam and cleaning chemical solution. The apparatus rinses the cleaned or stripped substrate with a water or water/solvent rinsing solution. The apparatus can be used as a hand-operated or a standalone unit and/or part of automated machinery or robotic assemblies.

In the exemplary implementations, the apparatus includes a cleaning head coupled to a steam generator with hoses, and separate water and chemical injection units. The steam generator and water/chemical injection units are located on a portable cart and/or vehicle and the cleaning head includes at least two steam nozzles connected separately to the steam generator and the units. One of the nozzles directs a steam/chemical stream from the first water/chemical injection unit that is used to clean/strip a contaminated surface. Another of the nozzles directs a steam/chemical stream from the second water/chemical injection unit that is used to rinse the cleansed/stripped surface. As such, the arrangement of the nozzles and the streams directed therefrom facilitate cleaning the contaminated surface and removing the chemicals used during the cleaning/stripping process. Furthermore, the design of the cleaning head, and more specifically the configuration of the rinsing nozzle, facilitates preventing chemicals used in the cleaning/stripping stream to airborne contaminate the surrounding area when the cleaning stream is directed from the cleaning nozzle towards the contaminated surface.

Figure 1:
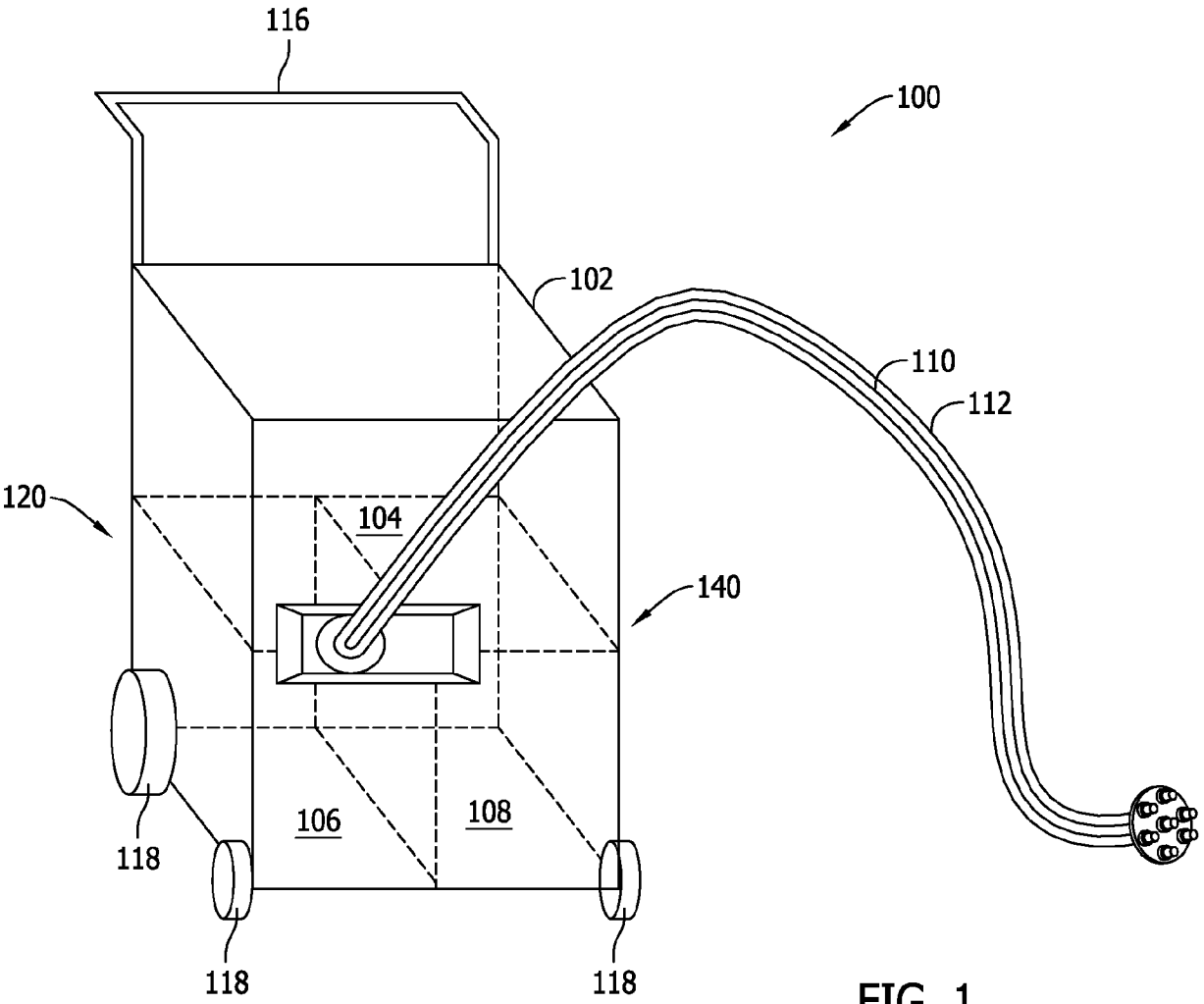
FIG. 1 is a perspective view of an exemplary cleaning system that may be used to clean a contaminated surface.

FIG. 1 is a perspective view of an exemplary cleaning system 100. In the exemplary implementation, cleaning system 100 includes a housing 102, a cleaning head 200, and a first hose 110 and second hose 112 that couples cleaning head 200 in flow communication with housing 102. Housing 102 includes a steam generation unit 104, a cleaning fluid injection unit 106, and a rinsing fluid injection unit 108. Steam generation unit 104 and cleaning fluid injection unit 106 define a cleaning fluid source 120, and steam generation unit 104 and rinsing fluid injection unit 108 define a rinsing fluid source 140. As such, in the exemplary implementation, first hose 110 is coupled in flow communication with and channels cleaning fluid to cleaning head 200 from cleaning fluid source 120, and second hose 112 is coupled in flow communication with and channels cleaning fluid to cleaning head 200 from rinsing fluid source 140.

In the exemplary implementation, housing 102 is mounted to and/or integrated with a portable cart 114 such that housing 102 is mobile. More specifically, portable cart 114 includes a handle 116 and wheels 118 such that portable cart 114 and housing 102 attached thereto may be selectively moved by an operator (not shown). In an alternative implementation, housing 102 may be mounted to a vehicle (not shown) or configured to be a stationary system mounted in, without limitation, a production facility, a maintenance facility, a repair facility, or any suitable combination thereof. Furthermore, as mentioned above, cleaning system 100 may be operated as a standalone unit and/or part of automated machinery or robotic assemblies (not shown).

In the exemplary implementation, cleaning fluid is generated from cleaning fluid source 120 for use by cleaning head 200. Cleaning fluid source 120 generates cleaning fluid by combining dry steam from steam generation unit 104 with a cleaning solution from cleaning fluid injection unit 106. More specifically, the cleaning solution contained within cleaning fluid injection unit includes water and at least one predetermined cleaning chemical. In the exemplary implementation, the cleaning fluid includes at least about 40% dry steam by weight, with the remainder being cleaning solution from cleaning fluid injection unit 106. As used herein, the term "dry steam" refers to steam that has less than about 5% liquid water by weight percentage.

The predetermined cleaning chemical may be any suitable cleaning chemical that enables cleaning system 100 to function as described herein. For example, suitable cleaning chemicals include, but are not limited to, an alcohol, a hydroxide, a detergent, a peroxide, and a surfactant.

In the exemplary implementation, rinsing fluid is generated from rinsing fluid source 140 for use by cleaning head 200. In one implementation, the rinsing fluid is about 100% wet steam that is generated by steam generation unit 104. In another implementation, rinsing fluid source 140 generates rinsing fluid by combining wet steam from steam generation unit 104 with a rinsing solution from rinsing fluid injection unit 108. In the exemplary implementation, the rinsing solution contained within rinsing fluid injection unit includes water and at least one predetermined rinsing solvent. In the exemplary implementation, the rinsing fluid includes at least about 85% wet steam by weight, with the remainder being rinsing solution from rinsing fluid injection unit 108. As used herein, the term "wet steam" refers to steam that has more than about 5% liquid water by weight percentage.

The predetermined rinsing solvent may be any suitable solvent that enables cleaning system 100 to function as described herein. Suitable rinsing solvents include, but are not limited to, ethyl alcohol, ethyl lactate, and combinations thereof.

Figure 2:
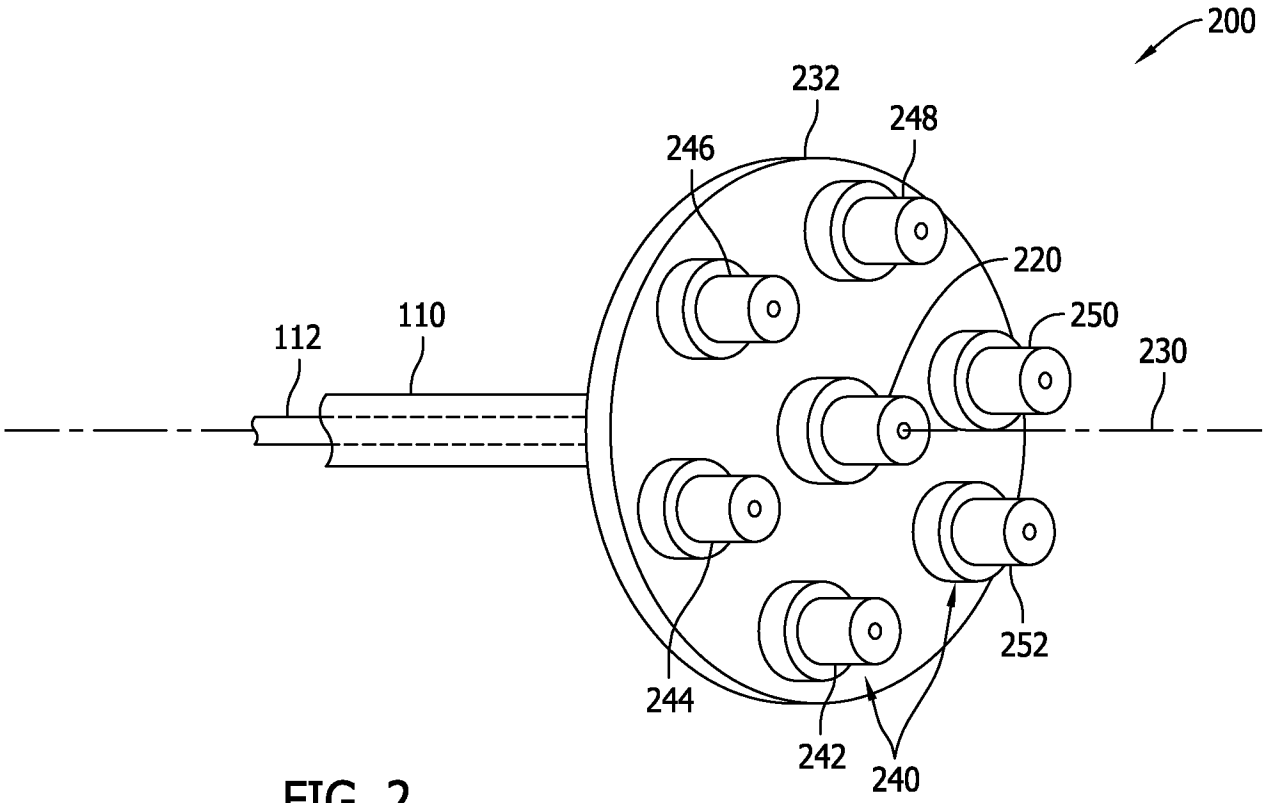
FIG. 2 is a perspective view of an exemplary cleaning head that may be used with the cleaning system shown in FIG. 1.
Figure 3:
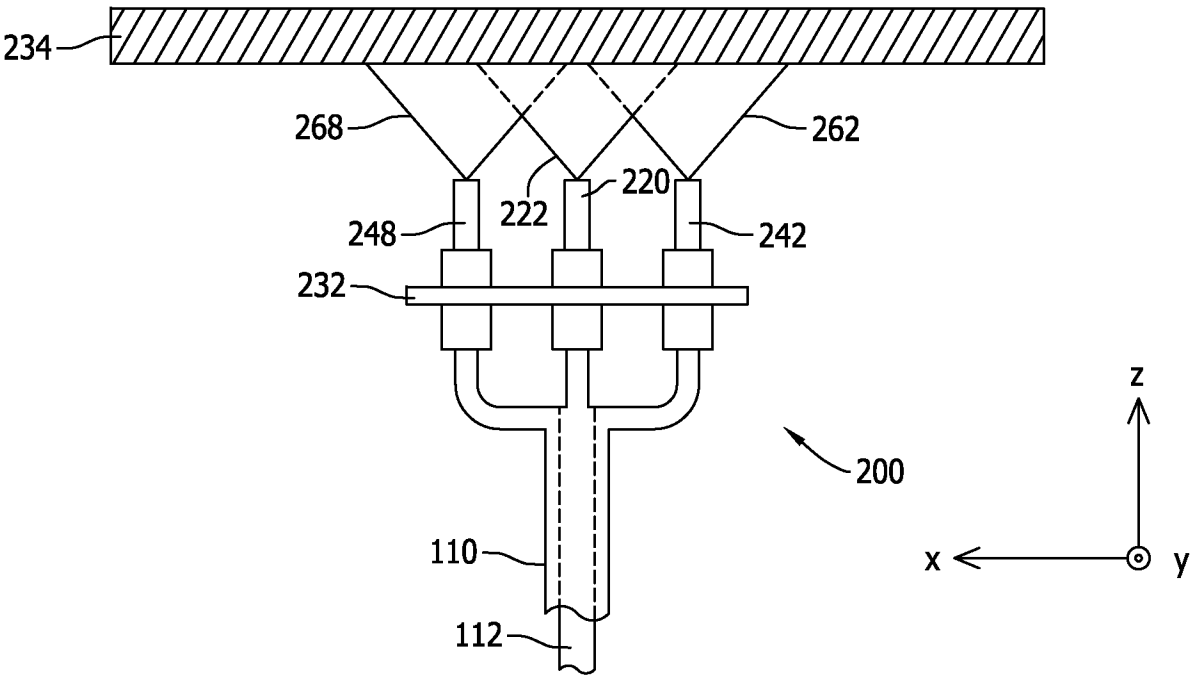
FIG. 3 is a perspective side view of the cleaning head shown in FIG. 2.
Figure 4:
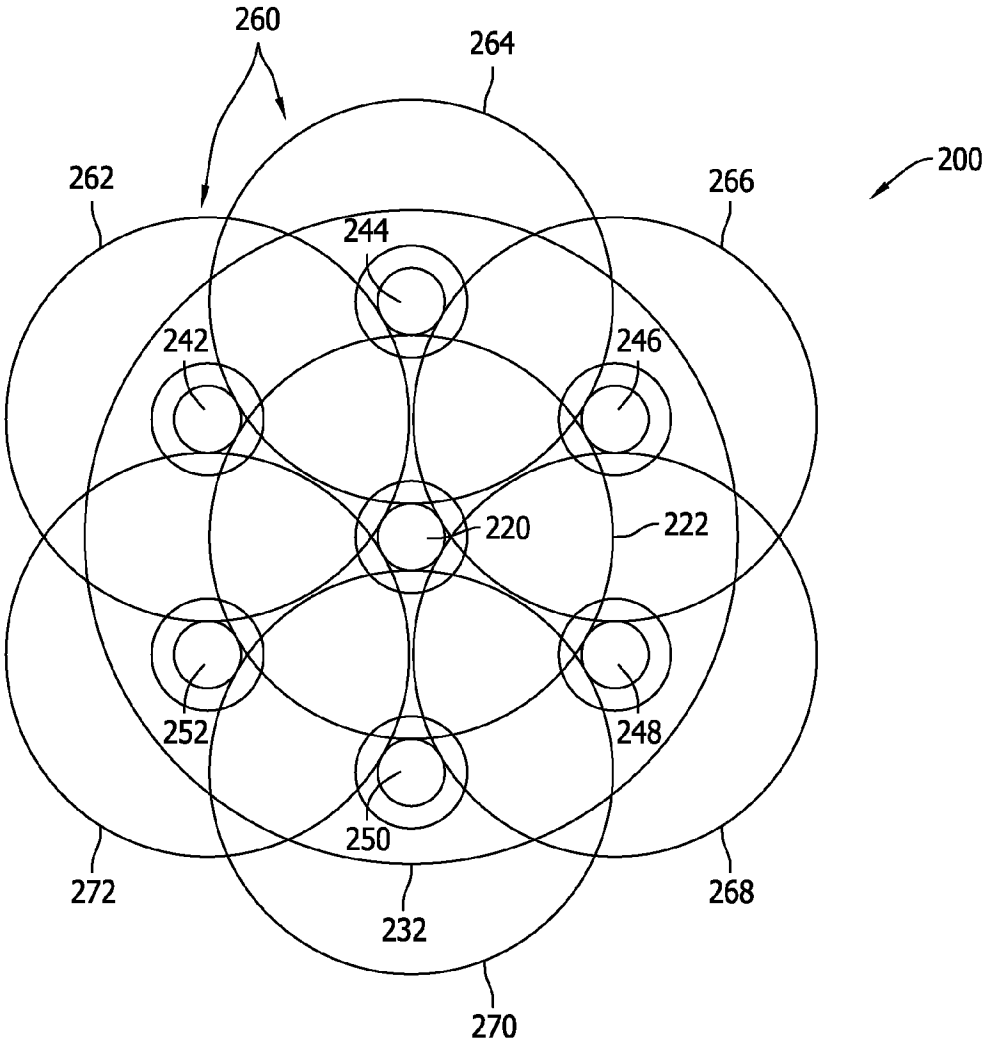
FIG. 4 is a perspective top view of the cleaning head shown in FIG. 2.

FIG. 2 is a perspective view of cleaning head 200 that may be used in cleaning system 100, FIG. 3 is a perspective side view of cleaning head 200, and FIG. 4 is a perspective top view of cleaning head 200. In the exemplary implementation, cleaning head 200 includes a cleaning nozzle 220, and at least one rinsing nozzle 240. For example, cleaning head 200 includes nozzles 242, 244, 246, 248, 250, and 252. In the exemplary implementation, cleaning nozzle 220 is aligned substantially coaxially with a centerline 230 of cleaning head 200, and rinsing nozzles 242, 244, 246, 248, 250, and 252 are spaced circumferentially about cleaning nozzle 220 with respect to centerline 230. More specifically, cleaning head 200 includes a guide piece 232 coupled to rinsing nozzles 240 such that rinsing nozzles 240 are substantially axially aligned with cleaning nozzle 220. Although shown as including six rinsing nozzles 240, cleaning head 200 may include any suitable number of rinsing nozzles 240 that enables cleaning head 200 to function as described herein.

During operation, cleaning nozzle 220 directs a cleaning jet 222 towards a contaminated surface 234 at a pressure sufficient to remove contaminants from contaminated surface 234. As will be understood by one of ordinary skill in the art, the pressure sufficient to remove contaminants from a contaminated surface depends on the particular cleaning operation. Accordingly, in some implementations, the cleaning jet pressure may be, but is not limited to, about 30 psi to about 500 psi. Cleaning nozzle 220 is configured to receive cleaning fluid from cleaning fluid source 120 (shown in FIG. 1) via first hose 110. Accordingly, cleaning jet 222 includes at least about 40% dry steam by weight, with the remainder being the cleaning solution.

Rinsing nozzles 240 direct a rinsing jet 260 to contaminated surface 234 simultaneously with cleaning jet 222 to remove the cleaning fluid and contaminants therefrom. Furthermore, rinsing nozzles 240 are arranged about cleaning nozzle 220 such that rinsing jets 260 directed therefrom substantially isolate cleaning jet 222 from the ambient environment. More specifically, in the exemplary implementation, nozzle 242 directs a rinsing jet 262 towards contaminated surface 234, rinsing nozzle 244 directs a rinsing jet 264 towards contaminated surface 234, rinsing nozzle 246 directs a rinsing jet 266 towards contaminated surface 234, rinsing nozzle 248 directs a rinsing jet 268 towards contaminated surface 234, rinsing nozzle 250 directs a rinsing jet 270 towards contaminated surface 234, and rinsing nozzle 252 directs a rinsing jet 272 towards contaminated surface 234. As such, rinsing jets 262, 264, 266, 268, 270, and 272 overlap with each other and substantially circumscribe cleaning jet 222 such that the at least one predetermined cleaning chemical included in the cleaning fluid and cleaning jet 222 does not airborne contaminate the ambient environment as cleaning jet 222 is directed from cleaning nozzle 220 to contaminated surface 234.

Furthermore, rinsing jets 260 are directed towards contaminated surface 234 at a pressure sufficient to isolate cleaning jet 222 from the ambient environment. In the exemplary implementation, the pressure sufficient to isolate cleaning jet 222 may be any suitable pressure that is equal to or greater than the cleaning jet pressure. Rinsing nozzles 240 are configured to receive rinsing fluid from rinsing fluid source 140 (shown in FIG. 1) via second hose 112. Accordingly, in one implementation cleaning jet 222 includes at least about 85% wet steam by weight, with the remainder being rinsing solution. In another implementation, cleaning jet 222 includes about 100% wet steam by weight.

Figure 5:
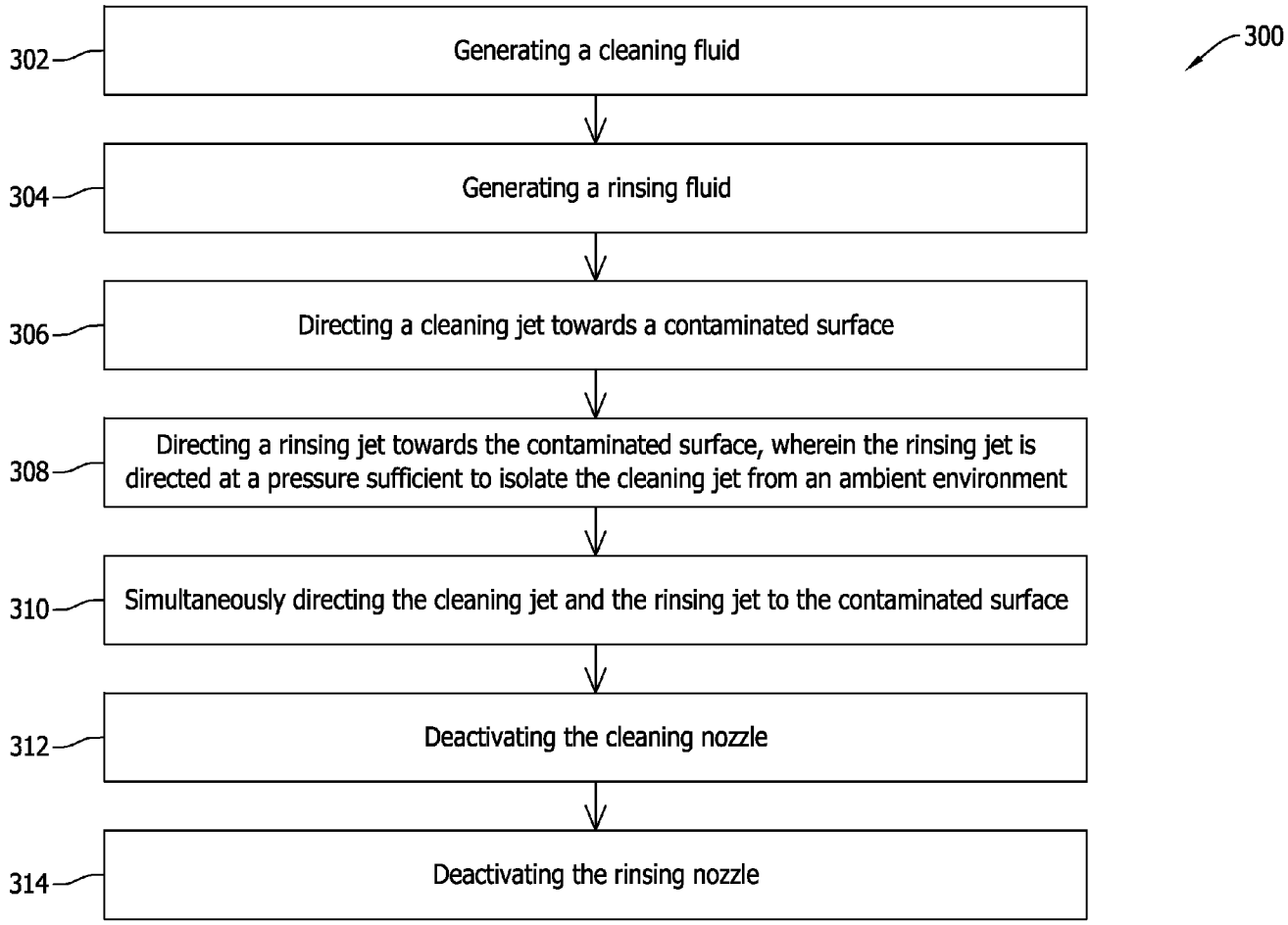
FIG. 5 is a flow diagram of an exemplary method of cleaning a contaminated surface that may be used with the cleaning system shown in FIG. 1.

FIG. 5 is a flow diagram of an exemplary method 300 of cleaning contaminated surface 234. During operation, method 300 may be used with cleaning system 100 to clean contaminated surface 234. In the exemplary implementation, cleaning fluid is generated 302 with cleaning fluid source 120 (shown in FIG. 1) that includes steam generation unit 104 (shown in FIG. 1) and cleaning fluid injection unit 106 (shown in FIG. 1). Rinsing fluid is generated 304 with rinsing fluid source 140 (shown in FIG. 1) that includes steam generation unit 104 and rinsing fluid injection unit 108 (shown in FIG. 1).

Method 300 also includes, directing 306 cleaning jet 222 (shown in FIG. 3) from cleaning fluid source 120 to contaminated surface 234 (shown in FIG. 3) to remove contaminants therefrom, and directing 308 rinsing jet 260 (shown in FIG. 4)

from rinsing fluid source 140 to contaminated surface 234 to facilitate removing cleaning fluid therefrom. In one implementation, rinsing jet 260 is activated before cleaning jet 222 to facilitate reducing airborne contamination caused by the predetermined cleaning chemical contained within the cleaning fluid. More specifically, in the exemplary implementation, cleaning jet 222 is directed 306 at a pressure sufficient to remove contaminants from contaminated surface 234, and rinsing jet 260 is directed 308 at a pressure sufficient to isolate cleaning jet 222 from an ambient environment. Furthermore, rinsing nozzles 240 (shown in FIG. 2) are arranged about cleaning nozzle 220 (shown in FIG. 2) such that rinsing jets 260 substantially circumscribe cleaning jet 222. In the exemplary implementation, cleaning jet 222 and rinsing jets 260 are simultaneously directed 310 towards contaminated surface 234 in continuous streams. As such, the predetermined cleaning chemical included in the cleaning fluid is substantially isolated from the environment as cleaning jet 222 is directed 306 from cleaning nozzle 220 to contaminated surface 234.

After contaminated surface 234 has been cleaned, cleaning nozzle 220 is deactivated 312, and then rinsing nozzles 240 are deactivated 314. In the exemplary implementation, deactivating 312 cleaning nozzle 220 before deactivating 314 rinsing nozzles 240 facilitates reducing recontamination of surface 234 by cleaning jet 222.

EXAMPLE

The following non-limiting simulation is provided to further illustrate the present disclosure.

Cleaning/stripping and rinsing of a contaminated surface was performed using an implementation of the present disclosure. The test was performed on a 2024-T3 clad aluminum substrate that had a 1 millimeter thick temporary protective coating (TPC) of Spraylat® ZR-5852 applied thereon ("Spraylat" is a registered trademark of Spraylat Corporation of Pelham, N.Y.). The TPC was applied to the aluminum substrate in a 3.5 inch×14.5 inch area, which equates to 50.75 $in^2$ of contaminated surface.

The cleaning fluid used was Windex® with Ammonia-D® ("Windex" and "Ammonia-D" are registered trademarks of S.C. Johnson & Son, Inc. of Racine, Wis.) that was converted into its vapor phase in a steam boiler, and the rinsing fluid used was steam and water. One cleaning nozzle and one rinsing nozzle were used, and the steam used was at a pressure of about 40 pounds per square inch (psi).

The cleaning apparatus described herein removed the TPC from the aluminum substrate at a rate of about 0.85 inches/second. As such, the TPC was removed from the aluminum substrate in about 60 seconds. Furthermore, 200 ml of water was used in the steam generation unit, and 200 ml of Windex® with Ammonia-D® was used during cleaning/stripping, which generated only 100 ml of chemical waste.

The cleaning apparatus described herein simultaneously cleans/strips and rinses a contaminated surface while facilitating preventing airborne contamination and facilitating reducing the amount of chemical waste generated by the cleaning/stripping process. More specifically, the cleaning apparatus uses a cleaning jet to remove contamination from the contaminated surface and at least one rinsing jet to remove the cleaning fluid and contamination from the contaminated surface. Generally, to facilitate removing contaminants from the contaminated surface, a cleaning chemical must be included in the cleaning jet. Such cleaning chemicals are expensive and may be harmful to the environment. As such, the cleaning fluid includes a mixture of steam and the cleaning chemical to facilitate reducing the amount of cleaning chemical required for cleaning a contaminated surface. Furthermore, the rinsing jets described herein are configured to substantially isolate the cleaning jet and chemicals contained therein from the environment as the cleaning jet is directed from the cleaning nozzle towards the contaminated surface. Accordingly, the cleaning apparatus described herein facilitates reducing the costs associated with cleaning a contaminated surface and facilitates protecting the environment from chemical waste.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A cleaning apparatus comprising:

a guide piece;

a cleaning fluid source;

a rinsing fluid source;

a first nozzle coupled to said guide piece and coupled in flow communication with said cleaning fluid source, said first nozzle configured to direct a cleaning jet towards a contaminated surface at a pressure sufficient to remove contaminants from the contaminated surface; and a plurality of second nozzles coupled to said guide piece and coupled in flow communication with said rinsing fluid source, said plurality of second nozzles configured to direct a rinsing jet towards the contaminated surface to remove cleaning fluid therefrom, said plurality of second nozzles positioned circumferentially about said first nozzle, wherein the rinsing jet is directed at a pressure sufficient to isolate the cleaning jet from an ambient environment, and wherein said first nozzle and said plurality of second nozzles are oriented on said guide piece such that the cleaning jet and the rinsing jet at least partially overlap before impinging against the contaminated surface.

2. The cleaning apparatus in accordance with claim 1, wherein said plurality of second nozzles is configured to direct the rinsing jet at a pressure that is one of equal to or greater than the cleaning jet pressure.

3. The cleaning apparatus in accordance with claim 1, wherein said first nozzle is configured to direct the cleaning jet that comprises dry steam and at least one cleaning chemical.

4. The cleaning apparatus in accordance with claim 3, wherein said first nozzle is configured to direct the cleaning jet that comprises at least 40% dry steam by weight.

5. The cleaning apparatus in accordance with claim 1, wherein said plurality of second nozzles is configured to direct the rinsing jet that comprises at least one of wet steam and a combination of wet steam and at least one solvent.

6. The cleaning apparatus in accordance with claim 5, wherein said plurality of second nozzles is configured to direct the rinsing jet that comprises at least 85% wet steam by weight.

7. The cleaning apparatus in accordance with claim 1, wherein said first nozzle and said plurality of second nozzles are configured to direct the cleaning jet and the rinsing jet towards the contaminated surface simultaneously.

8. A cleaning system comprising:

a housing comprising a cleaning fluid source and a rinsing fluid source housed therein; and a cleaning head coupled to said housing, said cleaning head comprising:

a guide piece;

a first nozzle coupled to said guide piece, said first nozzle configured to direct a cleaning jet towards a contaminated surface at a pressure sufficient to remove contaminants from the contaminated surface; and a plurality of second nozzles coupled to said guide piece, said plurality of second nozzles configured to direct a rinsing jet towards the contaminated surface to remove cleaning fluid therefrom, said plurality of second nozzles positioned circumferentially about said first nozzle, wherein the rinsing jet is directed at a pressure sufficient to isolate the cleaning jet from an ambient environment, and wherein said first nozzle and said plurality of second nozzles are oriented on said guide piece such that the cleaning jet and the rinsing jet at least partially overlap before impinging against the contaminated surface.

9. The cleaning system in accordance with claim 8, wherein said a plurality of second nozzles is configured to direct the rinsing jet at a pressure that is one of equal to or greater than the cleaning jet pressure.

10. The cleaning system in accordance with claim 8, further comprising at least one hose that couples said cleaning head in flow communication with said housing.

11. The cleaning system in accordance with claim 8, wherein said cleaning fluid source comprises a steam generation unit and a cleaning fluid injection unit, and wherein said rinsing fluid source comprises the steam generation unit and a rinsing fluid injection unit.

* * * * *